US008418592B1

(12) United States Patent
Gonstad et al.

(10) Patent No.: US 8,418,592 B1
(45) Date of Patent: Apr. 16, 2013

(54) FIREARM BASED BREACHING TOOL

(75) Inventors: Robert Gonstad, Hanceville, AL (US); Jacques A. Nevils, Fayetteville, NC (US)

(73) Assignee: Innovative Technologies, LLC, Hanceville, AL (US)

( * ) Notice: Subject to any disclaimer, the term of this patent is extended or adjusted under 35 U.S.C. 154(b) by 0 days.

(21) Appl. No.: 13/199,373

(22) Filed: Aug. 29, 2011

(51) Int. Cl.
*F41A 99/00* (2006.01)

(52) U.S. Cl.
USPC ..... 89/1.14

(58) Field of Classification Search ..... 42/1.12, 42/1.14, 79, 70.06; 89/1.3, 1.14; 137/68.13
See application file for complete search history.

(56) References Cited

U.S. PATENT DOCUMENTS

| | | | | |
|---|---|---|---|---|
| 2,259,989 | A * | 10/1941 | Barnes | 42/22 |
| 2,446,994 | A | 8/1948 | Barker | |
| 2,848,915 | A * | 8/1958 | Aitken et al. | 72/1 |
| 4,969,283 | A * | 11/1990 | Baehr | 42/70.01 |
| 5,415,241 | A | 5/1995 | Ruffu et al. | |
| 5,883,328 | A | 3/1999 | A'Costa | |
| 6,318,228 | B1 * | 11/2001 | Thompson | 89/1.14 |
| 6,889,591 | B2 | 5/2005 | Sabates et al. | |
| 7,305,788 | B1 | 12/2007 | McLain | |
| 7,434,785 | B1 | 10/2008 | McMorrow | |

* cited by examiner

*Primary Examiner* — Stephen M Johnson
*Assistant Examiner* — John D Cooper
(74) *Attorney, Agent, or Firm* — James L. Jackson

(57) ABSTRACT

A firearm based breeching tool uses the expansion gases of a blank high capacity firearm round to fire a piston at a breeching chisel, the chisel having a cutting head that is designed to breech a hardened obstacle. The invention is based on an assault rifle configuration that is modified to use the pump action of a shotgun to replenish a round of ammunition into the firing chamber and otherwise reset the device including the firing piston and the standard trigger mechanism.

12 Claims, 8 Drawing Sheets

FIREARM BASED BREACHING TOOL

BACKGROUND OF THE INVENTION

1. Field of the Invention

The present invention relates to a breaching tool used to breach through an entry obstacle such as a deadbolt, safety chain, etc., wherein a cutting chisel or ram is operationally impacted onto the obstacle via the discharge force from a firearms ammunition blank fired by the device. The tool is reset and a new blank placed into the firing chamber from the firearm's magazine via pump action.

2. Background of the Prior Art

Both police and military personal are often called on to breach a barrier such as a door in order to gain access to an interior of a structure and capture the persons and/or contraband therein. Such a breach must be quick in order to prevent the potential bad guys within the structure from taking a defensive position and attacking those making entry. In a typical structure, such as a house that has a standard deadbolt door thereon, a simple kick in or the use of a small battering ram is usually sufficient to quickly overcome the entry barrier. However, often the entry barrier is hardened such that those seeking entry need more force to disable the entry obstacle than can be supplied by human power alone. In such situations an appropriate machine is called upon to overcome the barrier obstacle.

One method employed to overcome a hardened entry barrier is to use a vehicle. A line, typically a cable or a chain, is tied to the entry obstacle with the other end tied to the vehicle. A winch on the vehicle or the locomotive power of the vehicle itself is used to pull the entry barrier away from the structure and allow personnel to enter. While this method works-quite well in many situations, it is not without its shortcoming. The use of a vehicle requires time to extend the cable or chain between the vehicle and the entry barrier which time can cause the occupants of the structure to detect the operation being performed and the element of surprise vanishes. Additionally, many doors are configured such that it is not practical to attach a chain or cable to such doors in rapid fashion, if at all. Furthermore, in many situations, such as during a combat foot patrol, an available vehicle to perform the pull operation is simply unavailable.

Another entry barrier disabling method uses explosives that are placed at the entry barrier's hardened points, such as the locks and the hinges, such that the explosive detonation disables these points in order to allow easy removal of the door. While effective, this method raises the possibility of collateral damage to both innocents as well as the combatants, which in today's litigious and 24 hour news cycle society is avoided at all costs.

Yet another entry barrier disabling method uses firearms based breaching tools. Essentially, such tools are modified firearms that use a blank firing round which, upon being fired, uses the force from the round's discharge gases to propel a ram with great force and speed at a target such as a lock, with the ram disabling the target. By using the force of a firearm round, a short pulse extremely violent high force burst is achieved by the ram in order to allow breeching of most defensive obstacles. These devices, which can be found in variety of architectures work with varying degrees of effectiveness, however, certain shortcomings can still be found.

One shortcoming is in devices that are pistol based. While a pistol round can expend great energy during discharge, in many hardened targets, such energy falls woefully inadequate to penetrate the defenses of the obstacle being targeted.

Many devices require rather extensive setup steps so that while the first use of the device can be achieved with relative ease, being setup well ahead of the breach attempt, if multiple ram impacts with the device are required, which is the case with many hardened entry barriers, subsequent iterations of the device can take time, which time may simply not be available. Many devices overcome this shortcoming by providing a rapid firing of the device so that some of the discharge gases are used to rechamber a round and reset the bolt carrier assembly for subsequent firings of the device. While effective, such devices require some of the energy from the expended round is used for resetting of the device which lessens the impact force of the ram. Additionally, the rapid firing of the device can be a hazard, especially to a novice user, as the percussive forces occasioned by the device can cause an operator to lose control of the device during rapid firing. Furthermore, these devices fail to assure that a live round, as opposed to a blank round, is not accidentally used with the device. A live round fired by these types of devices can cause catastrophic explosive failure of the device possibly resulting in serious injury or death to the operator and these in close proximity to the device. Such live rounds firing are possible with many prior art devices as such device are add-ons to existing firearms so that the firearm is usable both as a breeching tool and as a standard firearm. Carelessness can inadvertently cause such devices to be loaded with a live round when such live round use is strictly undesired.

What is needed is a firearm based breaching tool that allows an operator to use the high energy expended during a firearms blank round firing, which tool addresses the above mentioned shortcomings currently found in the art. Specially such a tool must allow an operator to be able to quickly and easily use the tool to ram a breach point and thereafter be able to quickly reset the device for additional ram iterations without having to use some of the energy of the discharged round for the resetting operation. Such a device must be able to use high capacity rounds in order to allow the tool to be used against well hardened obstacles. Such a tool must be relatively safe in operation without the potential for the operator to lose control of the device through repeated ramming iterations caused by inadvertent rapid firing of the device. Such a tool must be able to prevent the accidental use of live rounds within the device.

SUMMARY OF THE INVENTION

The firearm based breeching tool of the present invention addresses the aforementioned needs in the art by providing a breeching tool that relies on the discharge energy of a high capacity firearm arm round to ram a barrier entry obstacle. The firearm based breeching tool uses all of the energy of the discharged round for the ramming operation, relying on operator energy to reset the device for successive firing. The use of human energy for reset allows for controlled use of the device so that undesired rapid firing of the device is not possible. The firearm based breeching tool uses a familiar firearm architecture so that an operator has immediate comfort in the familiarity of the device so that use of the device is natural, yet the firearm based breeching tool has a hard safety feature that prevents the ability of the device from being loaded with a live round instead of a blank round. Essentially, an assault rifle is mated with a pump action reloading mechanism for cycling new ammunition into the firing chamber once the current ammunition is fired. The pump handle of the shotgun mechanism also resets a piston within the barrel, which piston impacts onto the anvil head of a chisel with the working end of the chisel performing the actual impact onto the target at hand. The use of the pump handle type of reloading and resetting of the device allows all of the energy from the fired ammunition round to be used to accelerate the chisel without needing to scavenge some of the expansion gasses for the reloading operation and also allows the operator of the device to have precise firing control of the unit.

The firearm based breeching tool is comprised of an assault rifle lower that has a magazine used to hold rounds of blank ammunition. A firearm upper has a firing chamber and a barrel with a first end proximate the firing chamber and a second open end. The firearm upper is mated with the assault rifle lower. The firearm upper also has a bolt carrier assembly for transporting a blank round of ammunition from the magazine into the firing chamber and expelling a cartridge of the round of ammunition after the ammunition is fired (the cartridge can include an unspent round such as if the round fails to fire or the weapon is cleared). A chisel is slidably disposed within the barrel and extends outwardly from the second end. A piston is slidably disposed within the barrel between the firing chamber and the ram. A pump handle is slidably attached to the outside of the firearm upper and is connected to the bolt via an operating rod. When the device is in a ready position, the chisel and the piston are both located toward the firing chamber. The chisel is held in place by a friction ring encompassing the chisel's anvil head while the piston is held in place by two small but powerful magnets (such as rare earth permanent magnets). The pump handle is cycled back toward the firing chamber and then forward toward the second end of the barrel thereby transporting a round of ammunition from the magazine and into the firing chamber. This action also resets the trigger assembly of the breeching tool so that when the trigger is pulled, the round of ammunition within the firing chamber fires thereby accelerating the piston onto the chisel causing the chisel to accelerate partially out of the second end of the barrel. A buffer spring assembly prevents the chisel from being expelled out from the second end of the barrel, the buffer spring assembly using a spring to dampen the travel of the chisel. A safety pin is disposed within the firing chamber wherein the pin prevents a live round of ammunition from being properly loaded within the firing chamber. The piston has a protruding pin that is received within a channel, the channel disposed within the barrel, the protruding pin also protrudes outside of the barrel tube. This protruding pin provides a means for the pump handle to reset the piston for the next firing as the pump handle, during its travel back toward firing chamber, catches the protruding pin and thereby moves the piston back toward the firing chamber.

BRIEF DESCRIPTION OF THE DRAWINGS

Similar reference numerals refer to similar parts throughout the several views of the drawings.

DESCRIPTION OF THE PREFERRED EMBODIMENT

Figure 1:
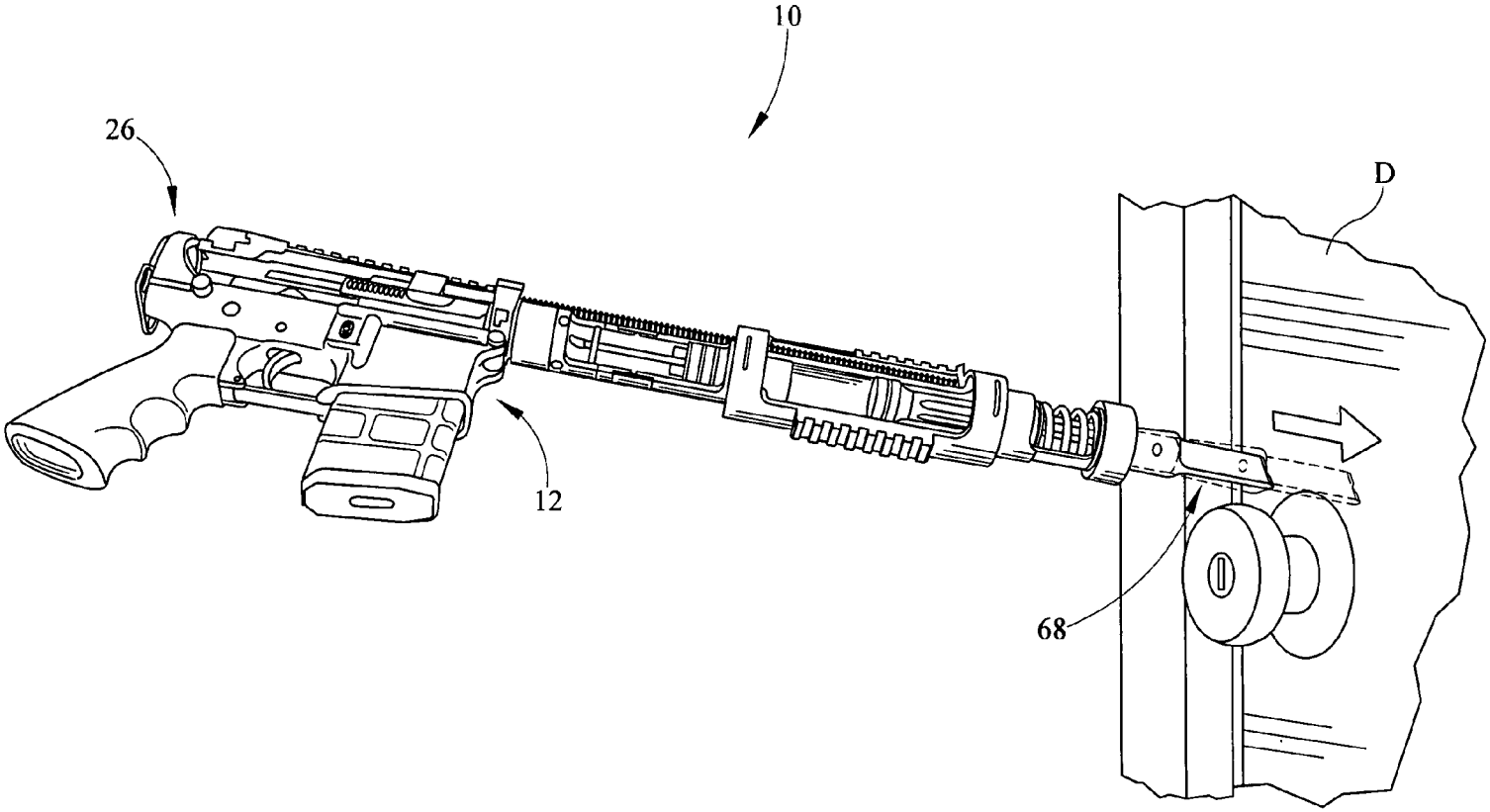
FIG. 1 is a perspective view, partially sectioned, of the firearm based breeching tool of the present invention being used to breech a door.
Figure 2:
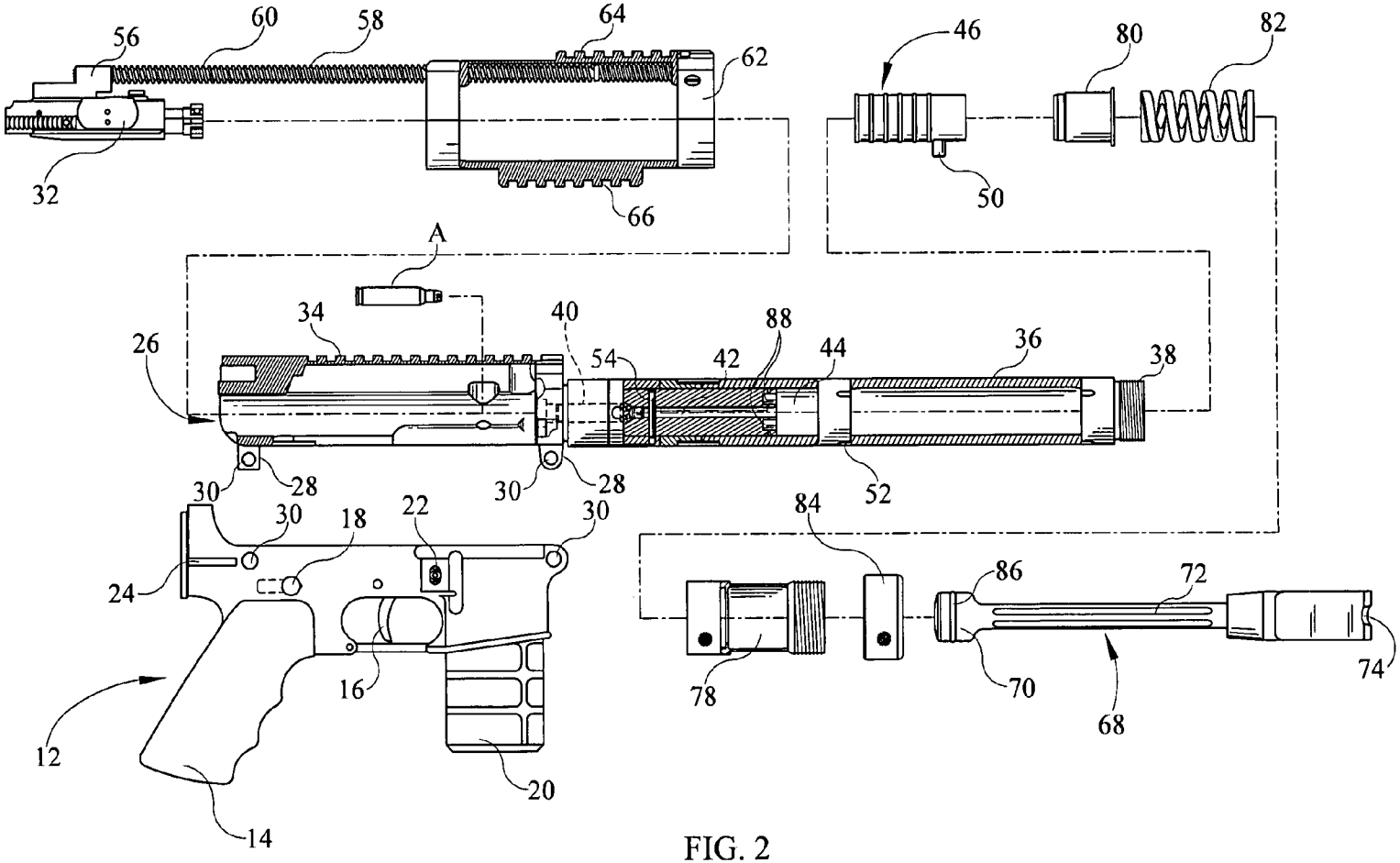
FIG. 2 is an exploded view, partially sectioned, of the firearm based breeching tool.
Figure 3:
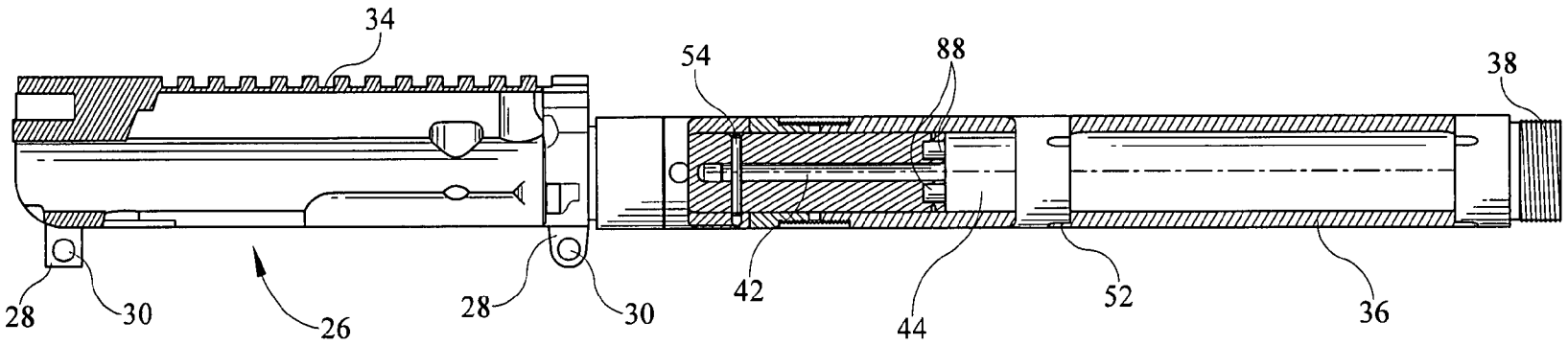
FIG. 3 is a plan view, partially sectioned, of the upper section of the firearm based breeching tool.
Figure 4:
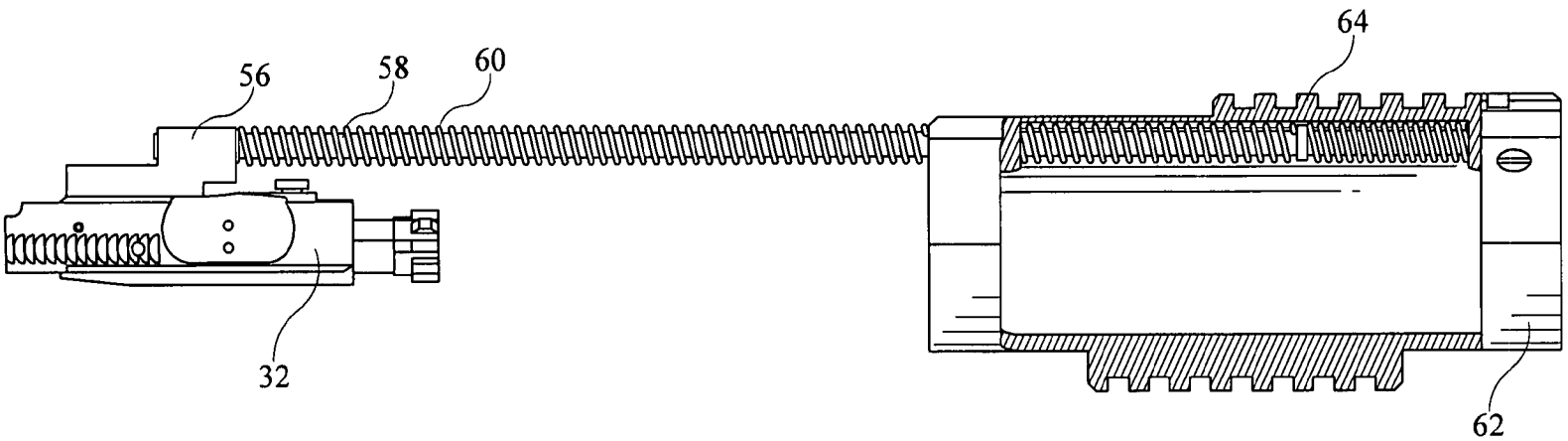
FIG. 4 is a plan view, partially sectioned, of the bolt carrier assembly and pump of the firearm based breeching tool.

Referring now to the drawings, it is seen that the firearm based breeching tool of the present invention, generally denoted by reference numeral 10, is comprised of a lower receiver 12, which as illustrated, is a typical lower receiver for an assault rifle such as the illustrated AR-15. The lower receiver 12 has the requisite components of a typical lower receiver that has all of the critical parts and functions for firing a round of an assault rifle lower receiver. While an off-the-shelf assault rifle lower receiver will function correctly, we have modified our lower receiver 12 by removing the stock, recoil spring tube (spring tube hole being capped), recoil spring, and buffer which are not essential for proper functioning of this invention 10. The lower receiver 12 has a grip 14, a trigger 16 of standard design, a selector lever 18, and a modified magazine 20 that receives multiple blank rounds A therein and which is dischargeable from the lower receiver 12 via an appropriate release 22, a spring and pin ridge 24, etc. By using a standard lower receiver 12, an operator, having familiarity with the firearm based breeching tool's live firing brethren, has immediate familiarity with the device 10.

An upper receiver 26 is removably attached to the lower receiver 12 in the well-known and understood way by aligning tabs 28 on the upper receiver 26 with appropriate receivers (not illustrated) on the lower receiver 12 and pinning the two receivers 12 and 26 together via the aligned apertures 30 on the two units 12 and 26. The upper receiver 26 is a typical assault rifle upper receiver with a modified barrel. The upper receiver 26 slidably receives a bolt carrier assembly 32 (although a typical bolt carrier will work properly, we have cut ours down so it does not protrude into the area that the recoil spring tube would typically occupy and thus cannot move rearward in order to chamber a round A) that slides within the upper receiver 26 for chambering and firing rounds A. The upper receiver 26 may also have an appropriate rail mount 34 thereon for mounting various accessories onto the device 10 such as a flashlight (not illustrated). Extending outwardly from the main body of the upper receiver 26 is a barrel 36 which has a threaded end 38 and a firing chamber 40, an expansion passage 42, and a piston receiver 44. A piston 46, encompassed by one or more ribs 48, is slidably disposed within the barrel 36 in alignment with the firing chamber 40, the piston 46 having a reset or protruding pin 50 which slides within a slot 52 disposed on the underside of the barrel 36. A chamber safety pin 54 is positioned within the chamber 40, so as to physically prevent live ammunition from being used within the device 10.

Attached to the bolt carrier assembly 32 via a operating rod block 56 is an operating rod 58 encompassed by a pump handle spring 60, the operating rod 58 is attached at its opposing end to a pump handle 62, the pump handle 62 encircling the barrel 36 and capable of sliding along the barrel 36 back toward the non-barrel end of the upper receiver 26, the pump handle 62 engaging the protruding pin 50 of the piston 46 when sliding back toward the non-barrel end of the upper receiver 26. As seen, an upper rail interface 64 and/or a lower rail interface 66 are located on the pump handle 62.

Figure 5A:
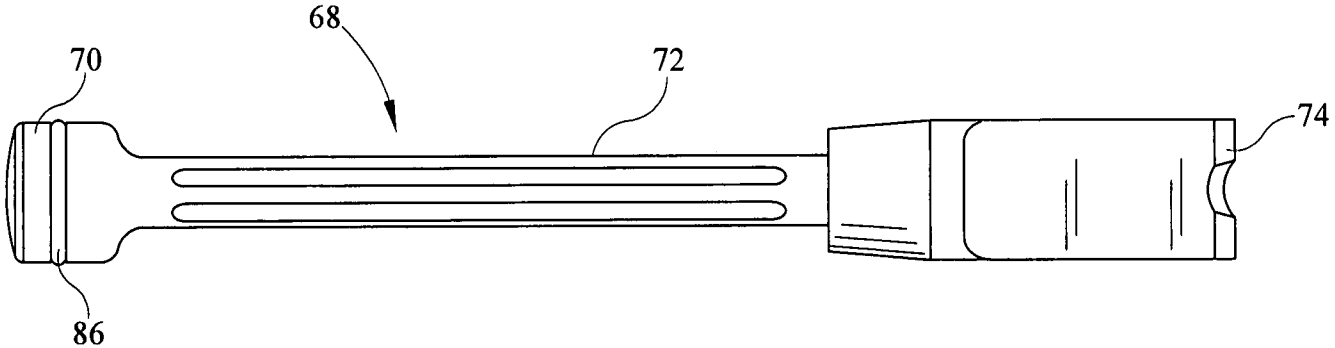
FIG. 5A is a plan view of the chisel used by the firearm based breeching tool.
Figure 5B:
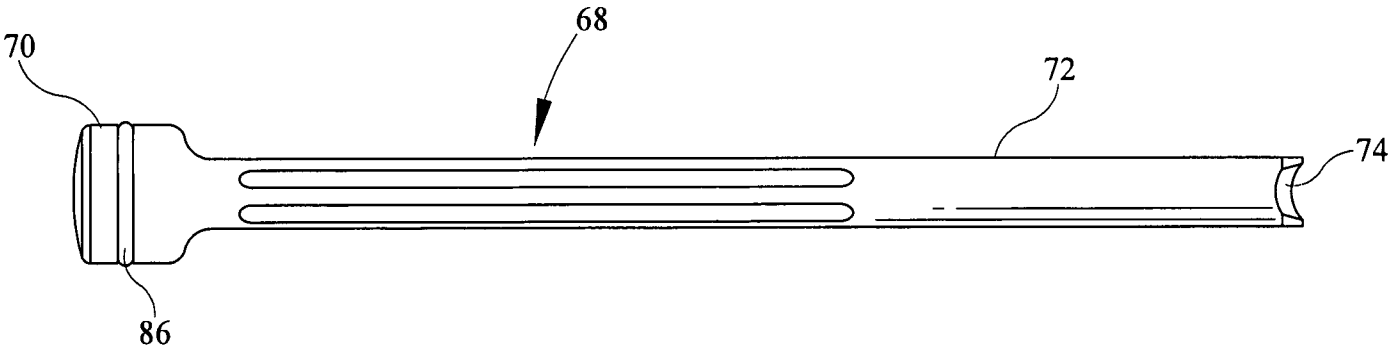
FIG. 5B is a plan view of an alternate embodiment of the chisel used by the firearm based breeching tool.
Figure 6:
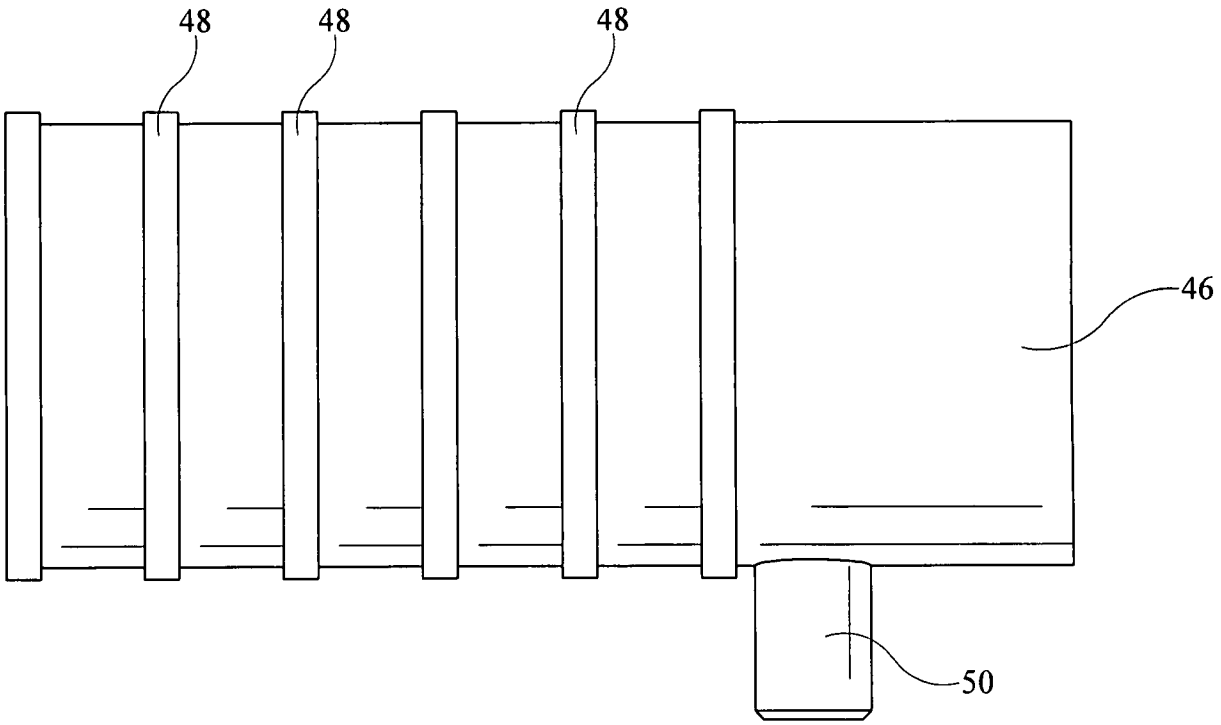
FIG. 6 is a plan view of the piston used by the firearm based breeching tool.
Figure 7:
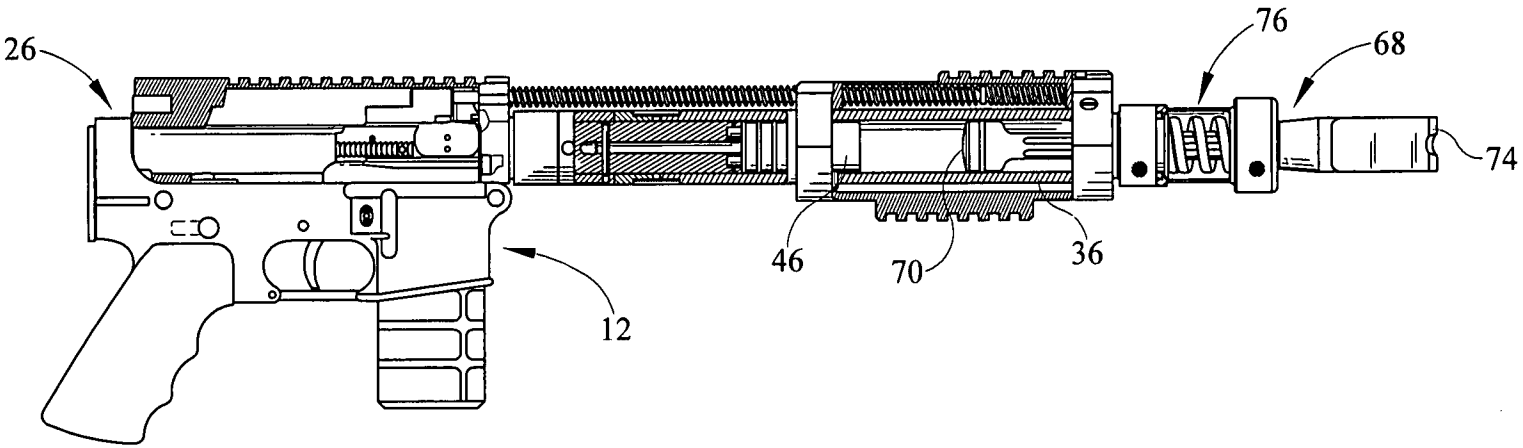
FIGS. 7-10 are plans views, partially sectioned, of the firearm based breeching tool cycling through a firing sequence.
Figure 8:
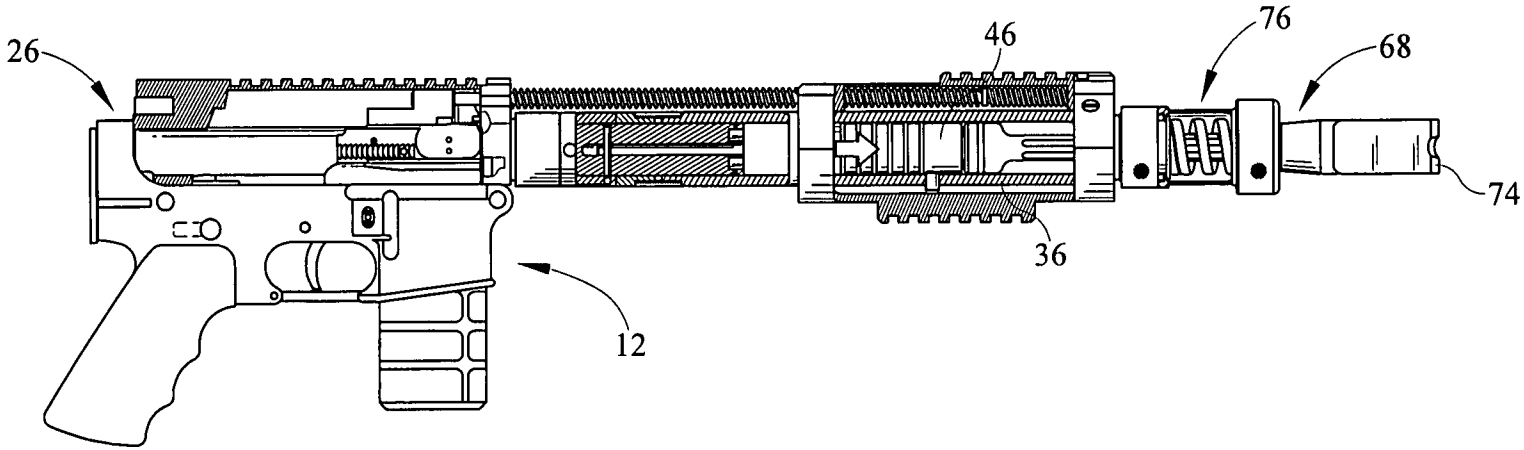
Figure 9:
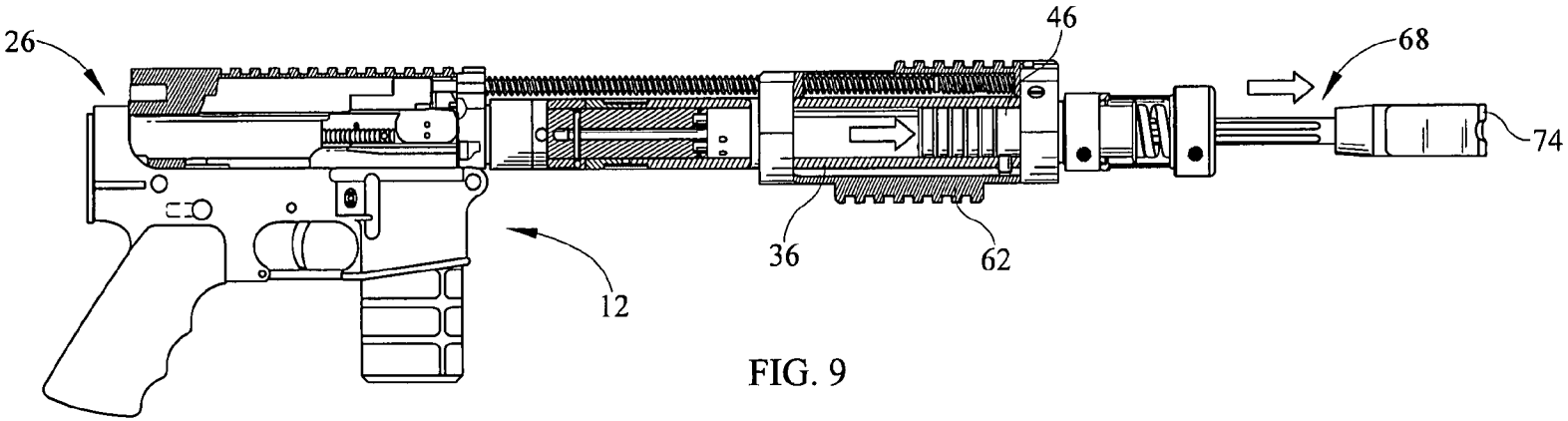
Figure 10:
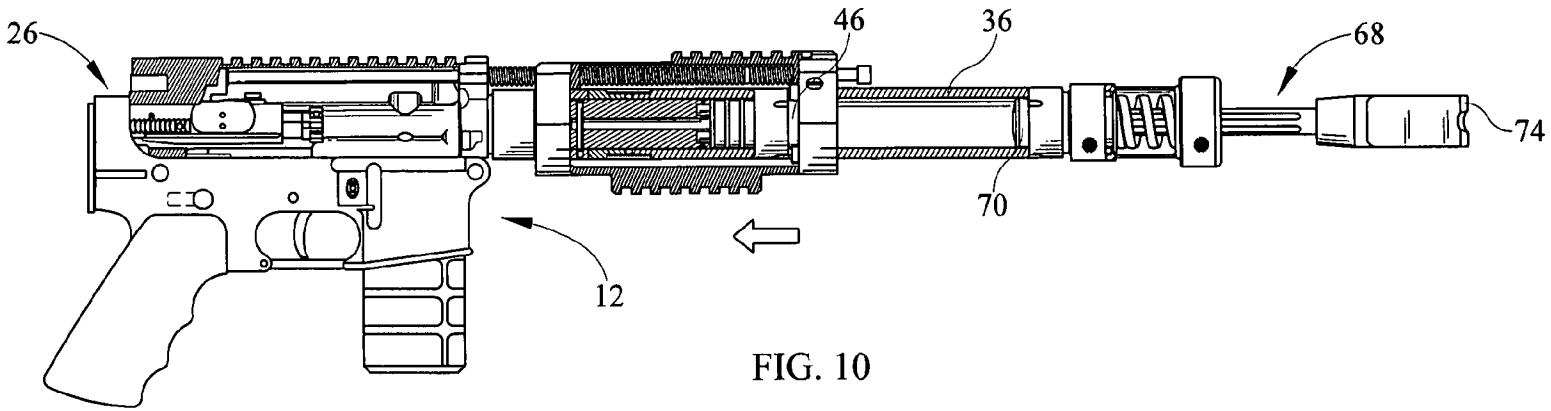

A breeching chisel 68 having an anvil end cap 70, a shaft 72 and an impact end 74 is slidably disposed within the barrel 36 such that the impact end 74 is located externally of the barrel 36. As seen in FIGS. 5A and 5B, the impact end 74 may be a large footprint impact end (FIG. 5A) or a small footprint impact end (FIG. 5B) depending on the needs of the job at hand.

A buffer spring assembly 76 is threadably attached to the end of the barrel 36, the buffer spring assembly 76 having a main body 78 that threadably attaches to the barrel 36 through which the chisel 68 passes. A dye spring retainer 80 is seated within a proximal end of the main body 78 and seats within the end of the barrel 36. The chisel 68 also passes through the dye spring retainer 80. A spring 82 is disposed within the main body 78 and is retained within the main body 78 via an end cap 84 that is threadably attached to the distal end of the main body 78. The spring 82 decelerates the chisel 68 during firing of the device 10 so as to prevent the chisel 68 from being blown out of the end of the barrel 36.

In assembly, the upper receiver 26 is attached to the lower receiver 12 and secured as appropriate. The piston 46 is positioned within the barrel 36. The chisel 68 is positioned within the barrel 36 and the buffer spring assembly 76 is threadably attached to the end of the barrel 36 with the chisel 68 passing there and through the spring 82 of the buffer spring assembly 76. A friction ring spring 86 encompasses the anvil head 70 of the chisel 68 and holds the chisel 68 in its set ready position within the barrel 36. The magazine 20 is loaded with rounds of blank ammunition A appropriate for the firearm at issue. A round A is chambered by sliding the pump handle 62 back toward the non-barrel end of the upper receiver 26, similar to loading a pump action shotgun. Sliding of the pump handle 62 causes the piston 46 to be slid toward and into the piston receiver 44 where at the piston 46 is held in the ready position by a pair of piston receiver magnets 88. The sliding of the pump handle 62 also causes a round A to be chambered into the firing chamber 40 of the upper receiver 26, which chambering also causes the trigger assembly to be placed into a firing position as is typical of such firearms. Essentially, the device 10 is manually reloaded via pump action pumping so that the device 10 is reloaded like a shotgun. As a blank round of ammunition A is shorter than a live round of the same caliber of ammunition, the chamber safety pin 54 is positioned so as to physically prevent a live round from fitting properly within the firing chamber 40 and thereby prevents a live round from being properly chambered within the device 10 so that if a person inadvertently loads the magazine 20 with live rounds, the chamber safety pin 54 prevents such a round from being chambered and fired. Once the blank round A is properly chambered and the pump handle 62 is returned to its ready position, the device 10 is ready for firing. In this position, the chisel 68 is positioned such that the friction ring 86 encompassing the anvil head 70 holds the chisel 68 in its placed position within the barrel 36 with the anvil head 70 positioned medially within the barrel 36. Once the round A is fired in the usual way, the gas expended by the round A passes through the expansion passage 42 and onto the piston 46. The expanding gas rapidly accelerates the piston 46 through the barrel 36 until the piston 46 impacts the anvil head 70 of the chisel 68, thereby rapidly accelerating the chisel 68 with the impact end 74 performing work such as penetrating a hardened door D. The buffer spring assembly 76 prevents the piston 46 from further travel toward the end of the barrel 36 while the end cap 84 prevents the chisel 68 from being expelled from the device 10. The spring 82 absorbs any excess forces on the chisel 68 in order to prevent the chisel 68 from being blown out of the end of the barrel 36. Porting (not illustrated) within the barrel 36 relieves any excess pressure within the barrel 36 whenever the piston 46 travels forward toward the chisel anvil 70, the proximal end of the piston 46 clears the slot 52 allowing any excess gas to escape through the slot 52 and be trapped within the pump handle 62.

If another iteration of the device 10 is needed, for example, multiple hinges must be breached, the pump handle 62 is pumped back and forth through another cycle thereby chambering another round A, resetting the piston 46 and the trigger mechanism, expelling the spent cartridge, reloading a new round A from the magazine 20, and readying the device 10 for another firing. Multiple iterations can be performed as needed. If additional rounds A are needed, the magazine 20 is removed from the lower receiver 12, replenished or replaced with a stocked magazine 20, and the device 10 continues use as desired.

While the invention has been particularly shown and described with reference to an embodiment thereof, it will be appreciated by those skilled in the art that various changes in form and detail may be made without departing from the spirit and scope of the invention.

We claim:

1. A breeching tool comprising:

a modified assault rifle lower having a magazine adapted to hold at least one round of blank ammunition and having the conventional butt-stock, buffer tube and recoil spring thereof removed;

a firearm upper having a firing chamber and a barrel having a first end proximate the firing chamber and defining a piston stop and a second open end, the firearm upper mated with the modified assault rifle lower, the firearm upper also having a bolt carrier assembly moveable therein for transporting a round of blank ammunition from the magazine into the firing chamber and expelling a cartridge case of the round of blank ammunition after the ammunition is fired;

a ram slidably disposed within the barrel and extending outwardly from the second end of said barrel;

a piston slidably disposed within the barrel between the firing chamber and the ram and being moveable toward said second end of said barrel by cartridge gas pressure to strike and impart impact force to said ram;

a pump handle slidably attached to the firearm upper and upon sliding movement toward said first end of said barrel causing sliding movement of said piston to a ready position within said barrel in engagement with said piston stop and in spaced relation with said ram;

said bolt carrier assembly being moveable within said firearm upper for blank cartridge handling and having an operating rod connecting said bolt carrier assembly with said pump handle for operating movement of said bolt carrier assembly by manual movement of said pump handle; and wherein when the breeching tool is in a ready position, the ram and the piston are each disposed in spaced and moveable relation within said barrel with the piston engaging said piston stop, and the pump handle is manually slid back toward the firing chamber and then forward toward the second end of the barrel thereby transporting a round of blank ammunition from the magazine and into the firing chamber and expelling a cartridge case if present within the firing chamber and also resetting a trigger assembly of the breeching tool, so that when the trigger assembly is pulled, the round of blank ammunition within the firing chamber discharges thereby developing gas pressure accelerating the piston onto the ram causing the ram to accelerate partially out of the second end of the barrel and apply impact force to a selected object.

2. The breeching tool as in claim 1 wherein a buffer spring assembly is mounted to said second end of said barrel and incorporates a buffer spring member that is positioned for cushioning engagement by said ram and prevents the ram from being expelled out from the second end of the barrel.

3. The breeching tool as in claim 2 further comprising a pin having a portion thereof disposed within the firing chamber wherein the pin prevents a live round of ammunition from being properly loaded within the firing chamber and permits a blank round of ammunition to be properly loaded within the firing chamber.

4. The breeching tool as in claim 3 wherein the piston has an alignment and reset pin projecting laterally therefrom that is disposed within a channel, the channel disposed along a length of the barrel, said alignment and reset pin being disposed for engagement by said pump handle during manual movement of said pump handle toward said first end of said barrel and causing movement of said piston to said ready position in engagement with said piston stop.

5. The breeching tool as in claim 1 wherein the piston has an alignment and reset pin projecting therefrom and being disposed within a channel, the channel disposed within and along a length of the barrel, said alignment and reset pin extending externally of said barrel for resetting engagement by said pump handle.

6. The breeching tool as in claim 1 further comprising a chamber safety pin disposed within a pin receptacle intersecting the firing chamber wherein the chamber safety pin prevents a live round of ammunition from being properly loaded within the firing chamber and permits a blank round of ammunition to be properly loaded within the firing chamber.

7. A breeching tool comprising a firearm that has a modified assault rifle based platform having an assault rifle lower with the conventional butt-stock buffer tube and recoil spring removed and a firearm upper being connected in releasable assembly and having a barrel mounted to said firearm upper and having a firing chamber and defining a piston receiver and a ram receiving portion and an open end;

a ram slidably disposed within said ram receiving portion of said barrel of the firearm and having a portion thereof extending out of said open end of the barrel such that whenever a blank round of ammunition is fired by the firearm, a portion of the ram is accelerated out from the open end of the barrel and imparts an impact force to an object;

a buffer spring assembly mounted to said barrel and having a stop preventing the ram from being discharged from the open end of the barrel;

a bolt carrier assembly being moveable within said firearm upper;

a magazine adapted to contain at least one round of blank ammunition being supported by said assault rifle lower and positioning said blank ammunition for charging into said firing chamber by said bolt carrier assembly;

a manually operable sliding pump handle encircling said barrel for reciprocating movement along a portion of the length of said barrel and having an operating rod interconnecting said bolt carrier assembly and said pump handle for ammunition handling movement of said bolt carrier assembly by said manually operated pump handle; and a spent cartridge within a firing chamber of the firearm being expelled from the firing chamber and a new round of ammunition is loaded into the firing chamber from a magazine of the firearm by said bolt carrier assembly by sliding pump action movement of said manually operated sliding pump handle following firing of a blank cartridge and impacting action of said ram.

8. The breeching tool as in claim 7 wherein said buffer spring assembly defines a main body mounted to said open end of said barrel and containing a compression spring; and an end cap securing said compression spring within said main body and defining a stop permitting cushioning contact of said ram with said compression spring of said buffer spring assembly and preventing the ram from being expelled out from the second end of the barrel.

9. The breeching tool as in claim 8 further comprising a chamber safety pin having a part thereof disposed within the firing chamber wherein the chamber safety pin prevents a live round of ammunition from being properly loaded within the firing chamber and permits a blank round of ammunition to be properly loaded within the firing chamber.

10. The breeching tool as in claim 9 wherein the piston has an alignment and reset pin that is disposed within a channel, the channel disposed along a length of the barrel, said pump handle engaging said alignment and reset pin and moving said piston toward said firing chamber following firing actuation of said breeching tool.

11. The breeching tool as in claim 7 wherein the piston has an alignment and reset pin that is disposed within a channel, the channel disposed along a length of the barrel, said pump handle engaging said alignment and reset pin and moving said piston toward said firing chamber following firing actuation of said breeching tool.

12. The breeching tool as in claim 7 further comprising a chamber safety pin having a portion thereof disposed within the firing chamber wherein the pin prevents a live round of ammunition from being properly loaded within the firing chamber.

* * * * *